US005099281A

United States Patent [19]

Bhagat

[11] Patent Number: 5,099,281

[45] Date of Patent: Mar. 24, 1992

[54] ELECTROPHOTOGRAPHIC INTERPOSITION DEVELOPMENT WITH MEANS FOR REMOVING MOISTURE FROM CONVENTIONAL PAPER

[75] Inventor: Gopal C. Bhagat, Houston, Tex.

[73] Assignee: Compaq Computer Corporation, Houston, Tex.

[21] Appl. No.: 597,894

[22] Filed: Oct. 15, 1990

[51] Int. Cl.[5] ..... G03G 15/18

[52] U.S. Cl. ..... 355/217; 355/273; 430/126

[58] Field of Search ..... 355/215, 273, 308, 309, 355/30, 311, 217; 219/216; 358/300; 346/153.1, 159; 430/122, 126, 48

[56] References Cited

U.S. PATENT DOCUMENTS

| | | | |
|---|---|---|---|
| 4,193,680 | 3/1980 | Yoshikawa et al. | 355/273 |
| 4,591,885 | 5/1986 | Day et al. | 346/159 |
| 4,853,743 | 8/1989 | Nagumo et al. | 355/30 X |
| 4,994,855 | 2/1991 | Ohashi et al. | 355/217 X |

FOREIGN PATENT DOCUMENTS

| | | | |
|---|---|---|---|
| 0011358 | 1/1982 | Japan | 355/217 |

*Primary Examiner*—Joan H. Pendegrass
*Assistant Examiner*—William J. Royer
*Attorney, Agent, or Firm*—James R. Burdett

[57] ABSTRACT

An electrophotographic printer develops a toned image directly on a sheet of conventional paper, such as bond paper, without first forming the toned image on a layer of photoconductive material. The sheet of conductive paper is ordinarily electric conductive, owing to its relatively high moisture content. Therefore, prior to positioning the sheet of paper adjacent the layer of photoconductive material, the sheet of paper is first dried by heating to a temperature sufficient to evaporate the moisture content therein to a level of less than 3% by weight of the conventional paper. Once the sheet of conventional paper is dried, it is inserted between a developer and the layer photoconductive material so that toner particles attracted to a latent image on the layer of photoconductive material are intercepted by the dried sheet of conventional paper.

15 Claims, 4 Drawing Sheets

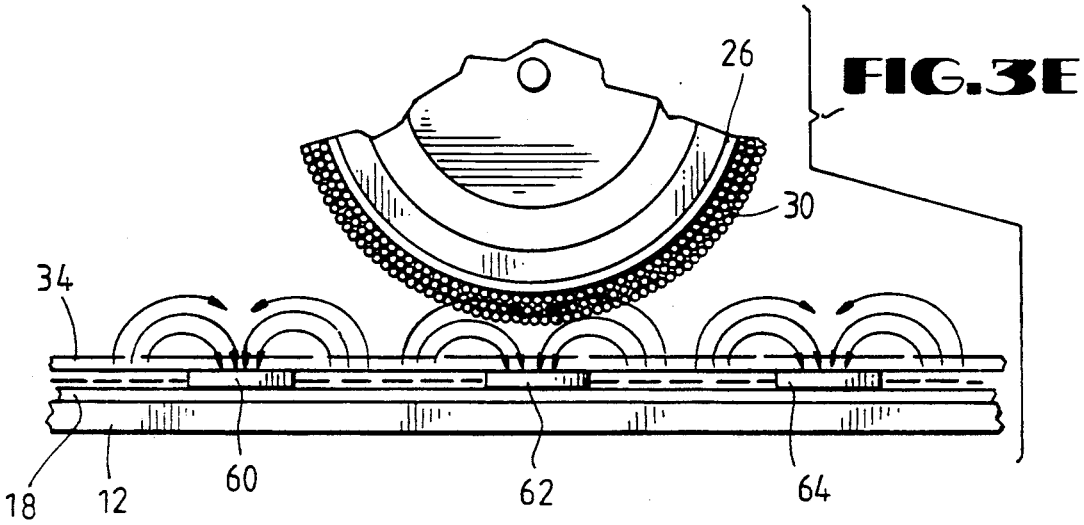
FIG.3E
FIG.3F
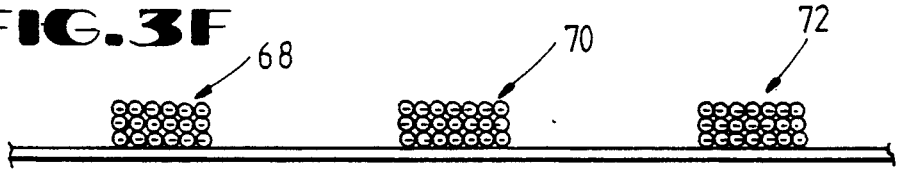
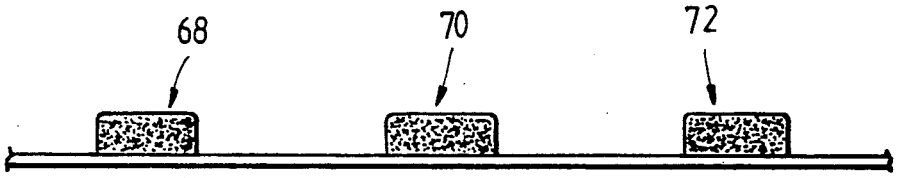
FIG.3G

ELECTROPHOTOGRAPHIC INTERPOSITION DEVELOPMENT WITH MEANS FOR REMOVING MOISTURE FROM CONVENTIONAL PAPER

BACKGROUND OF THE INVENTION

1. Field of the Invention

This invention is generally related to a method and apparatus for electrophotographic printing in which a charge image is placed directly on a conventional paper product and, more particularly, to a method and apparatus of electrophotographic printing in which the paper product to be printed upon is interposed between a developer and a layer of photoconductive material whereby toner is deposited directly on the conventional paper product.

2. Description of the Related Art

In the field of electrophotography, the process for printing a toned image on a sheet of conventional paper involves a series of eight steps. In the first step, a charge corotron or alternative, compatible charging means establishes a uniform charge on the surface of a photoconductor. Typically, the photoconductor takes the form of an outer surface on a rotating drum or a linearly moving photoconductor belt. Thus, as the drum rotates past the charge corotron, a charge is placed thereon. Thereafter, in the second step of this process, a latent image is borne electronically on the photoconductor through a laser source arranged in a configuration matching the image to be printed. For example, in a xerographic copier, a high intensity light source is reflected off of the document to be copied and onto the surface of the photoconductor. Thus, in the area of the document where no printing appears, the light source is strongly reflected onto the surface of the photoconductor. Conversely, where dark images or printing appears on the document to be copied, the light source is not reflected. The photoconductor responds to the reflected light by conducting the positive charge to system ground at each location exposed to the light source. Thus, the surface of the photoconductor contains a latent image of the document to be reproduced wherein the latent image area is represented by, for example, a positive charge.

Alternatively, in, for example, an electrophotographic printer, the photoconductor is exposed to a patterned light source, such as a controllable optical diode (e.g., a semiconductor laser diode). A controller selectively exposes the surface of the photoconductor to the optical diode to produce preselected charge patterns, such as, alphanumeric characters on the surface of the photoconductor. In this manner, the printer is used to produce a page of printed text.

In step three of this process the charge image is developed into a toned, latent image on the surface of the photoconductor. This toned image is created by exposing the surface of the photoconductor to toner particles, which are attracted to the discharged surface areas of the photoconductor. Thus, a toned, latent image is formed on the surface of the photoconductor. In the fourth step of this process, a conventional sheet of paper is fed in a timely manner into the electrophotographic printer in close proximity to the surface of the photoconductor.

The fifth step of this process involves transferring the toned, latent image from the surface of the photoconductor to the sheet of conventional paper. This transfer is typically accomplished by positioning the sheet of paper between the photoconductor surface and a second charge corotron. The second charge corotron operates to attract the toner particles from the surface of the photoconductor toward the corotron. However, since the sheet of conventional paper is disposed between the corotron and the photoconductor, the sheet of conventional paper intercepts the toner particles and the toned, latent image is formed on the surface of the sheet of conventional paper. Thereafter, in the seventh step of this process, the toner particles are affixed to the sheet of conventional paper by fusing the toner particles. This fusing is accomplished by, for example, a heater disposed adjacent the paper and adapted for heating the toner particles to a temperature sufficient for melting and adhering the particles to the sheet of conventional paper.

It should be appreciated that this process is not 100% efficient. Therefore, some cleaning of the photoconductor surface is necessary to remove toner particles that remain thereon and were not transferred to the sheet of conventional paper. Therefore, the seventh step of this process involves cleaning the photoconductor surface by, for example, a mechanical stripper that scrapes against the surface of the photoconductor and removes any remaining residual image. Finally, in the eighth step of this process it is preferable that the photoconductor surface be completely discharged so that any remaining charge placed thereon is removed before the process is repeated again. Removing the charge ensures that the photoconductor surface is completely cleaned of any residual toner. When the photoconductor (sometimes referred to as "OPC") is discharge, the toner particles are no longer attracted to the photoconductor surface.

The electrophotographic process described above has several inherent disadvantages. First, it is generally recognized that the process of transferring the toned, latent image from the photoconductor surface to the sheet of conventional paper is not 100% effective. Thus, the toned image placed on the surface of the sheet of conventional paper is a less than 100% accurate representation of the toned, latent image originally formed on the photoconductor surface. Thus, the ultimate product of the electrophotographic printing process is of a slightly reduced quality because of the inherent shortcomings in the transfer process step.

The above-described electrophotographic process also suffers from an inherent shortcoming that arises from the toned, latent image being formed directly on the photoconductor and the less than perfect transfer process. The disadvantages associated with these two steps necessitate the seventh step in the process of cleaning the photoconductor. Typically, the mechanical stripper is in actual frictional contact with the surface of the photoreceptor so that after a period of time the photoconductor surface is mechanically worn by contact with the cleaning stripper.

The instant invention is directed to overcoming or at least reducing one or more of the problems described above.

SUMMARY OF THE INVENTION

In one aspect of the instant invention, an electrophotographic printer is provided. The printer includes a power supply having first and second terminals adapted for delivering electrical power therethrough. A drum is constructed from an electrically conductive material and is connected to the first power supply terminal. The drum is rotatable along its longitudinal axis. A layer of photoconductive material is disposed on an outer surface of the rotatable drum and the drum and the layer of photoconductive material are rotated in a first rotational direction about the longitudinal axis of the drum. A charge corotron is positioned adjacent the drum and is connected to the second power supply terminal. The charge corotron is adapted for depositing a charge of a preselected polarity on the layer of photoconductive material. An imaging device is positioned adjacent the charge corotron and the drum. The imaging device is adapted for exposing the layer of photoconductive material to a patterned source of light (e.g., a scanning laser beam) so that selected portions of the electrical charge are removed from the surface of the photoconductive material whereby a desired latent image is formed on the surface of the photoconductive material. While the latent image is being impressed on the photoconductor, moisture is removed from the sheet of conventional paper so that the sheet of conventional paper is substantially nonconductive. A series of transport rollers positioned between the means for removing moisture and the drum so that the transport rollers receive the sheet of conventional paper from the means for removing moisture and feed the sheet of conventional paper onto the drum. The sheet of conventional paper is positioned adjacent the surface of the photoconductive material between the surface of the photoconductive material and a supply of toner particles (to a plurality of selected areas by an appropriate xerographic development means) whereby a substantial number of toner particles are attracted toward the latent image and collect on a surface of the sheet of conventional paper, instead of on the photoconductor, in a pattern corresponding to the latent image. On the downstream, a heater is adapted for receiving the sheet of conventional paper with the toner particles positioned thereon and heating the sheet of conventional paper with the toner particles thereon so that the toner particles fuse together and to the conventional sheet of paper.

In another aspect of the instant invention, a method is provided for electrophotographic printing on a sheet of conventional paper. The method includes the step of placing an electrical charge of a preselected polarity on the surface of a photoconductive material. Thereafter, selected portions of the electrical charge are removed from the surface of the photoconductive material whereby a desired latent image is formed on the surface of the photoconductive material. Next, moisture is removed from the sheet of conventional paper so that the sheet of conventional paper is substantially nonconductive and the sheet of conventional paper is positioned adjacent the surface of the photoconductive material, between the surface of the photoconductive material and a supply of toner particles from a xerographic development means by a selective electric field mechanism. A substantial number of toner particles are attracted toward the latent image and collect on a surface of the sheet of conventional paper in a pattern corresponding to the latent image. Finally, the sheet of conventional paper with the toner particles thereon is heated so that the toner particles fuse together and to the conventional sheet of paper.

BRIEF DESCRIPTION OF THE DRAWINGS

Other objects and advantages of the invention will become apparent upon reading the following detailed description and upon reference to the drawings in which:

FIGS. 3A–G illustrate a schematic side view of the series of steps performed by the electrophotographic printer.

Figure 1:
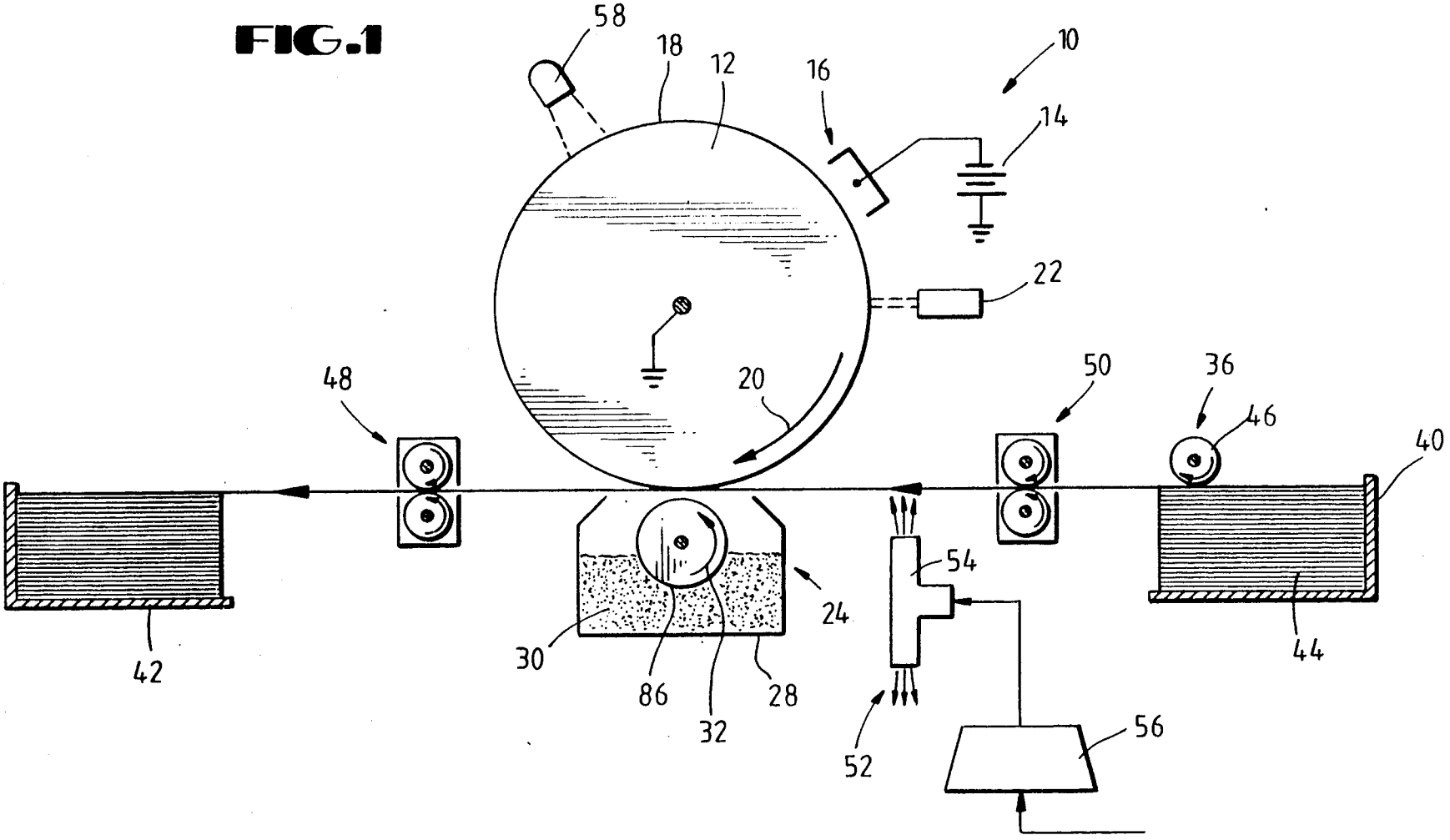
FIG. 1 illustrates a schematic side view of the major operating components in an electrophotographic printer embodying the principals of the instant invention.

While the invention is susceptible to various modifications and alternative forms, specific embodiments thereof have been shown by way of example in the drawings and will herein be described in detail. It should be understood, however, that the specification is not intended to limit the invention to the particular forms disclosed therein, but on the contrary, the intention is to cover all modifications, equivalents, and alternatives falling within the spirit and scope of the invention, as defined by the appended claims.

DESCRIPTION OF A PREFERRED EMBODIMENT

Turning to the drawings and referring first to FIG. 1, a schematic side view of the major operating components of an electrophotographic printer 10 embodying the principals of the instant invention is illustrated. The printer 10 includes a drum 12 constructed from an electrically conductive material (e.g., steel, aluminum, etc.) and connected to the ground terminal of a power supply 14. The power supply 14 can take the form of any suitable electrical device and, for purposes of simplicity herein, is illustrated as a battery. The negative terminal of the battery 14 is connected to a charge corotron 16.

Therefore, it should be readily apparent that a voltage differential exists between the drum 12 and the corotron 16 corresponding to the voltage produced by the battery 14. This voltage differential induces an electrical charge on the surface of the drum 12. Ordinarily, since the drum 12 is electrically conductive and connected to the ground terminal of the battery 14, any charge deposited on the surface of the drum 12 would quickly dissipate. However, the outer surface of the drum 12 is covered with a layer of photoconductive material 18. As is well know, the photoconductive material 18 is controllably switchable between a conductive and nonconductive state. When the photoconductive material 18 is exposed to a light source, it becomes conductive and dissipates any charge present thereon. Otherwise, the photoconductive material remains in its nonconductive state.

During operation of the electrophotographic printer 10, the drum 12 is rotated in the clockwise direction, as indicated by an arcuate arrow 20. Means for driving the drum 12 in the clockwise direction can take the form of any suitable drive mechanism and, preferably, is an electric motor (not shown) attached to one end of the drum 12 via a belt, transmission mechanism, or the like (not shown). Therefore, as the drum 12 rotates in the clockwise direction, the entire circumferential surface of the drum 12 ultimately passes beneath the charge corotron 16, thereby depositing a charge of a preselected polarity on the photoconductive material 18. Preferably, the charge placed on the photoconductive material 18 is generally uniform and has a magnitude of approximately 700 V.

After the circumferential surface of the drum 12 passes the corotron 16, it moves adjacent a controlled optical diode 22. The diode 22 is capable of accurately exposing selected surface regions of the photoconductive material 18. These exposed regions are promptly rendered conductive and dissipate the charge placed thereon by the corotron 16. Therefore, the unexposed regions remain charged, such that a pattern of charged and uncharged regions may be readily produced. For example, the optical diode 22 can be used to discharge selected regions which constitute as discharged in a pattern that corresponds in shape to alphanumeric characters. In this manner, the electrophotographic printer 10 can be used to produce a latent image on the photoconductive material 18 representative of a printed page.

After the photoconductive material 18 has been exposed and a latent image formed, rotation of the drum 12 moves this latent image through a developer 24. The developer 24 can take the form of any known development process that readily transfers toner to the latent image. For example, a system of applying toner that uses a magnetic roller 26 is readily adaptable for use in the instant invention. The magnetic roller 26 is described in greater detail in conjunction with FIG. 2, below. Here, it is sufficient to understand that the magnetic roller 26 is located within a bin 28 containing toner particles 30. The magnetic roller 26 rotates in a counterclockwise direction, as indicated by an arcuate arrow 32, and in substantial unison with the drum 12. The toner particles 30 are attracted to the magnetic roller 26 and are transported around the roller 26 into a region adjacent the drum 12 and the latent image. The toner particles 30 are strongly attracted to the discharged regions of the latent image so that they migrate from the magnetic roller 26 in a direction toward the latent image.

The toner particles 30 do not, however, reach the photoconductive material 18. Rather, the toner particles 30 are intercepted by a sheet of conventional paper 34.

A series of transport rollers 36 are adapted for receiving the sheet of conventional paper 34 from a tray 40 and conveying the sheet of paper 34 along a path generally indicated by arrows 38. The path 38 extends from the input tray 40, through a heating means 50, between the drum 12 and the developer 24, and to an output tray 42. The input tray 40 is suitable for retaining a stack of individual sheets of paper 44 and selectively delivering the top sheet of the stack of paper 44 in a timely fashion along the path 38. A rubber wheel 46 is positioned in contact with the top sheet of the stack of paper 44 and is rotated in the clockwise direction by, for example, an electric motor (not shown). The wheel 46 is in substantial frictional contact with the stack of paper 44 so that the top sheet of paper is urged in a direction toward the developer 24 and drum 12 along the path 38. Timing of the rotation of the wheel 46 is designed to cause the paper 34 to travel along the path 38 in substantial synchronism with rotation of the drum 12. Further, the starting time for rotating the wheel 46 is selected to cause the single sheet of paper 34 to enter between the developer 24 and drum 12 at the same time as the latent image. Thus, the toner particles 30 that are attracted to the latent image are intercepted by the sheet of paper 34, forming a toned version of the latent image on the surface of the sheet of paper 34.

The sheet of paper 34 is, thereafter, passed through a heater 48. The heater 48 heats the sheet of conventional paper 34 with the toner particles thereon so that the toner particles 30 fuse together and to the conventional sheet of paper 34. Once this fusing process is complete, the sheet of fused paper is transferred to the output tray 42.

It should be appreciated that a conventional sheet of paper, such as bond paper, is ordinarily electrically conductive. Thus, when the sheet of paper 34 passes between the photoconductive material 18 and the developer 24, it comes into substantial contact with the photoconductive material 18 and, owing to its conductive property, dissipates the latent image on the surface of the photoconductive material 18. Therefore, before interposing the paper 34 between the drum 12 and developer 24, the paper 34 is first rendered nonconductive.

Conventional paper owes its conductivity to moisture that is inherently present in all conventional paper products. For example, bond paper typically has a moisture content of approximately 5% by weight. However, for bond paper to be substantially nonconductive, the moisture content should be almost zero percent. Accordingly, a drier unit 50 is disposed between the paper tray 40 and the developer 24. The drier unit 50 receives the conventional sheet of paper 34 from the stack of paper 44 and heats the sheet of conventional paper 34 to a temperature sufficient for evaporating moisture contained in the paper 34. Preferably, the drier unit 50 heats the sheet of paper 34 for a period of time and to a temperature sufficient for reducing the moisture content of the conventional sheet of paper to a level of less than 3% by weight of the conventional sheet of paper 34, and more preferably to about zero percent. Once the paper is sufficiently dried by the drier unit 50, it is delivered between the developer 24 and drum 12.

It should be noted that a paper temperature in excess of 100F may cause damage to the photoconductive material 18. Accordingly, it is preferable that a cooling unit 52 be disposed between the drier unit 50 and the developer 24. The cooling unit 52 can take a form of any of a variety of refrigerating devices, including a vortex tube 54 such as the type manufactured and sold by Transonix Corporation of Lowell, Massachusetts. As is well know, vortex tubes incorporate the principal of the Ranque-Hilsch tube to provide a relatively dry air stream that can be as much as 110F lower than the inlet supply air temperature. The vortex tube 54 receives its pressurized input air supply from a standard compressor 56. The drier unit 50 is schematically similar to the heater 48. Preferably, the heater 48 and drier unit 50 are substantially identical and, in fact, the heater 48 that is commonly used in electrophotographic printers may be readily adapted for use as the drier unit 50. However, those knowledgeable concerning the operation of vortex tubes recognize that the vortex tube 54, in addition to supplying a cold air stream, also supplies a relatively hot air stream. Thus, the drier unit 50 could readily take the form of the hot air stream from the vortex tube 54 being delivered into a region adjacent the sheet of conventional paper 34.

The final stage in the operation of the electrophotographic printer 10 is to remove the latent image from the surface of the photoconductive material 18. A light source 58 is positioned adjacent the drum 12 in a region that is displaced from the charge corotron 16 in the "upstream" direction of rotation. Thus, the light source 58 renders the entire surface of the photoconductive material conductive and discharges and dissipates the residual image thereon so that the process may begin anew.

Referring simultaneously to FIGS. 2 and 3A–G, a more detailed description of the operation of the electrophotographic printer 10 and, in particular, the magnetic roller 26 and its interaction with the drum 12 and the sheet of conventional paper 34 is illustrated. FIGS. 3A–G illustrate linear representations of a segment of the drum 12 at various stages in the electrophotographic printer process. The process described herein is that which is normally performed in an electrophotographic printer however, the process normally used in a xerographic copier is substantially similar, differing mainly in the polarity of the charge applied to the photoconductive material 18.

Figure 3A:
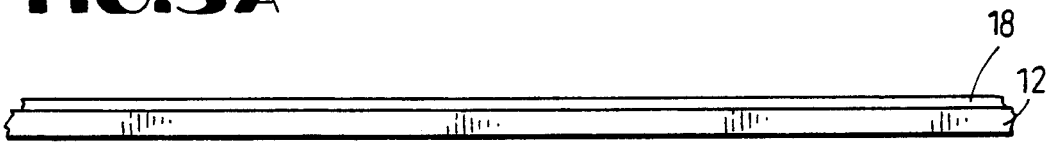
Figure 3B:
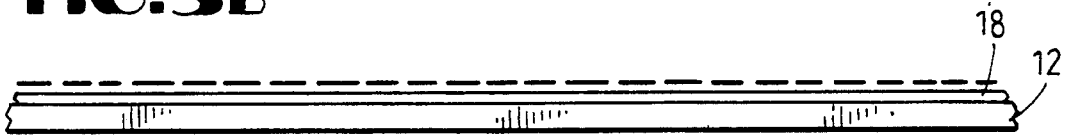
Figure 3C:
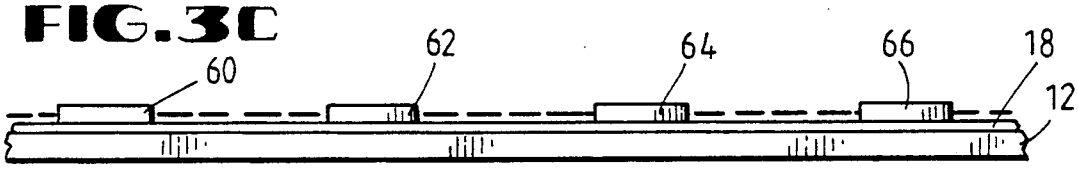

FIG. 3A illustrates a segment of the drum 12 in the region adjacent the light source 58. The photoconductive 10 material 18 is completely free from any electrical charge thereon, owing to exposure by the light source 58. FIG. 3B illustrates a segment of the drum 12 adjacent the corotron 16. The photoconductive material 18 now contains a uniform negative charge distributed thereon. Preferably, the charge is approximately −700 V. FIG. 3C illustrates a segment of the drum adjacent the optical diode 22. A plurality of regions 60, 62, 64, 66 have been exposed to the optical diode 22 so that the charge thereon has substantially dissipated. Preferably, the charge remaining in the dissipated regions 60, 62, 64, 66 is approximately −50 V.

Figure 3D:
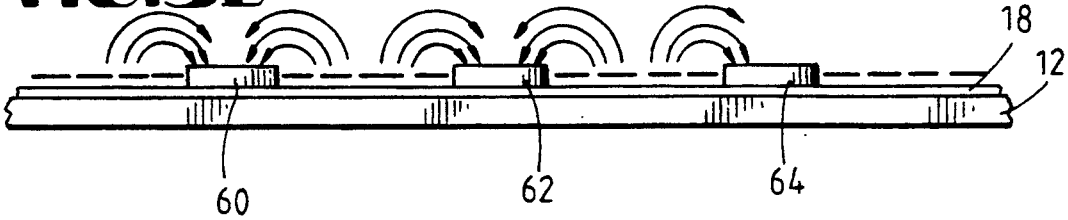

FIG. 3D illustrates the field configuration of the charge on the surface on the photoconductive material 18. Field lines are represented by a series of arcuate arrows extending from the highly charged regions to the dissipated regions 60, 62, 64. Thus, it should be appreciated that any toner particles that are introduced into the region adjacent the photoconductive material 18 would tend to follow the repulsive field lines and collect in the dissipated regions 60, 62, 64. For example, FIG. 3E illustrates the magnetic roller 26 positioned in proximity with the drum 12. The field lines extend from the highly charged regions through the toner particles 30, Which are carried on the magnetic roller 26, and to the dissipated regions 60, 62, 64. Thus, the toner particles are attracted from the magnetic roller 26 toward the dissipated regions 60, 62, 64. The sheet of conventional paper 34 is, however, interposed between the magnetic roller 26 and the photoconductive material 18. The sheet of conventional paper 34 passes the field lines but intercepts the toner particles. Thus, the toner particles collect on the surface of the sheet of paper 34 in a pattern of regions 68, 70, 72 that correspond to the dissipated region 60, 62, 64. Thereafter, the sheet of paper is passed through the heater 48 and the toner particles are fused together and to the sheet of paper 34 in the pattern of regions 68, 70, 72, thereby completing the printing process.

Figure 2:
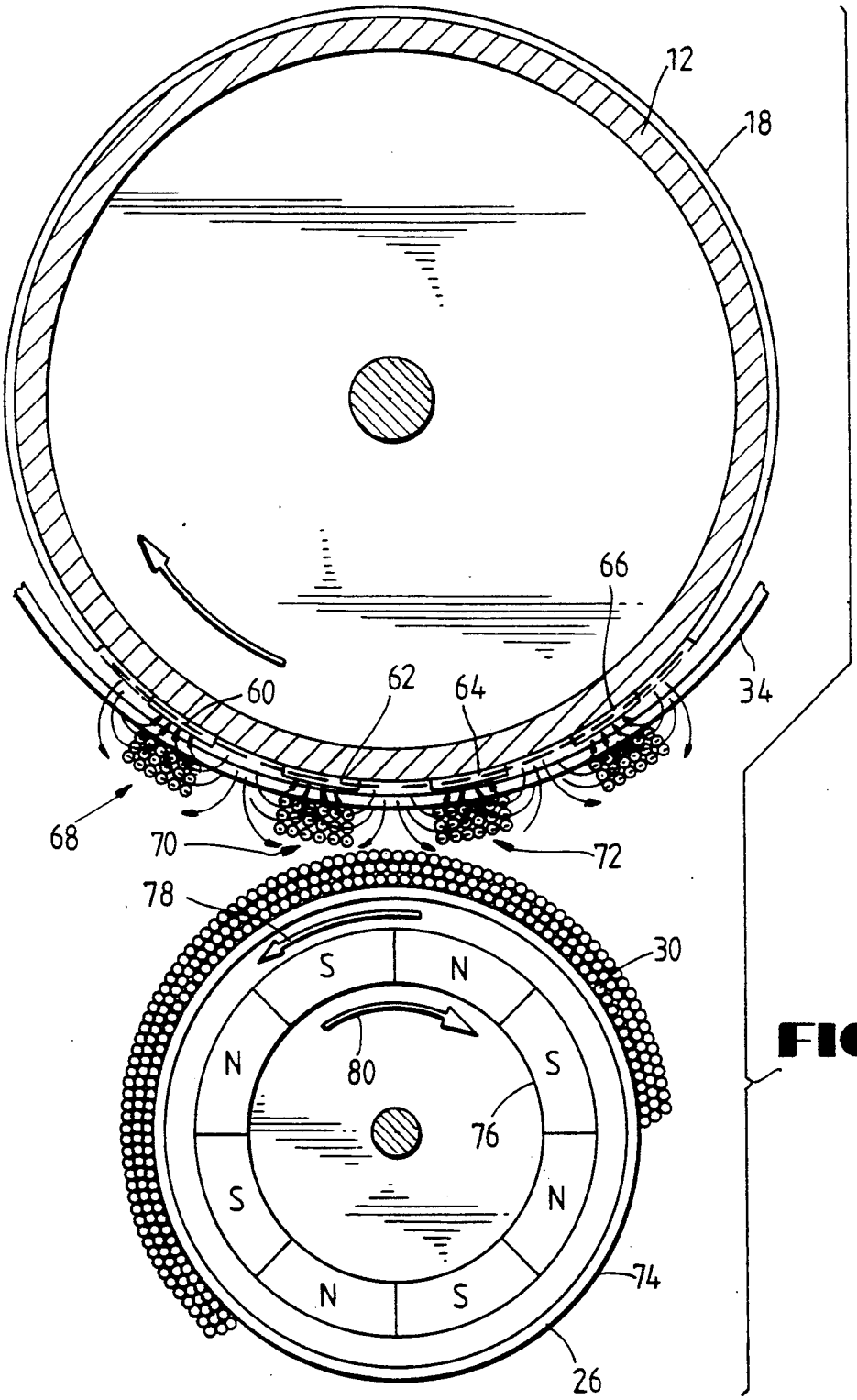
FIG. 2 illustrates a schematic cross sectional side view of a photoconductive drum and magnetic roller used to distribute toner particles on a sheet of conventional paper.

Referring now to FIG. 2, the operation of the magnetic roller 26 is discussed in greater detail. The magnetic roller 26 consists of an outer sleeve 74 and an inner ring 76 consisting of a plurality of alternating north and south magnetic poles. The sleeve 74 is connected to rotate in a counterclockwise direction, as indicated by the arcuate arrow 78. Ordinarily, the speed of rotation of the outer sleeve 74 corresponds to the rotational speed of the drum 12. The inner magnetic ring 76 is configured to rotate in the clockwise direction, as indicated by the arcuate arrow 80. The sleeve 74 and inner ring 76 are rotated in their respective directions by, for example, an electric motor (not shown) attached to one end of the magnetic roller 26 via a belt, transmission mechanism, or the like (not shown). The toner particles are attracted to the sleeve 74 by the magnetic inner ring 76 and are transported into a region adjacent the sheet of paper 34 by rotation of the sleeve 74. In this manner, a constant supply of toner particles is readily available for transfer to the sheet of paper 34. Counter rotating the magnetic ring 76 and sleeve 74 weakens the attraction of the toner particles to the sleeve 74 so that they may readily be dislodged by the field of the latent image and transported to the sheet of paper 34.

While the developer 24 has been described herein as employing a magnetic roller 26, those skilled in the art will readily recognize that any suitable developer may be readily substituted for the magnetic roller 26 without departing from the spirit and scope of the instant invention.

I claim:

1. A method of electrophotographic printing on a sheet of conventional paper, comprising the steps of:
   - placing an electrical charge of a preselected polarity on the surface of a photoconductive material;
   - removing selected portions of said electrical charge from the surface of said photoconductive material whereby a desired latent image is formed on the surface of said photoconductive material;
   - removing moisture from said sheet of conventional paper so that said sheet of conventional paper is substantially nonconductive;
   - positioning said sheet of conventional paper adjacent the surface of said photoconductive material and between the surface of said photoconductive material and a supply of toner particles whereby a substantial number of toner particles are attracted toward said latent image and collect on a surface of said sheet of conventional paper in a pattern corresponding to said latent image; and
   - heating said sheet of conventional paper with said toner particles thereon so that the toner particles fuse together and to the sheet of conventional paper.

2. A method, as set forth in claim 1, wherein said step of removing moisture includes heating said sheet of conventional paper to a temperature sufficient for evaporating moisture contained in said sheet of conventional paper.

3. A method, as set forth in claim wherein said step of removing moisture includes heating said sheet of conventional paper for a period of time and to a temperature sufficient for reducing the moisture content of said sheet of conventional paper to a level of less than 3% by weight of the sheet of conventional paper.

4. A method, as set forth in claim 1, wherein said step of removing moisture includes drying said sheet of conventional paper to reduce the moisture content of said sheet of conventional paper to a level of less than 3% by weight of the sheet of conventional paper.

5. A method, as set forth in claim 1, including cooling said sheet of conventional paper to a preselected temperature after the step of removing the moisture therefrom and before the step of positioning said sheet of conventional paper.

6. A method, as set forth in claim 5, including directing a cold air stream from a vortex tube into a region adjacent said sheet of conventional paper.

7. A method of electrophotographic printing on a sheet of conventional paper, comprising the steps of:

placing an electrical charge of a preselected polarity on the surface of a photoconductive material;

removing selected portions of said electrical charge from the surface of said photoconductive material whereby a desired latent image is formed on the surface of said photoconductive material;

heating said sheet of conventional paper to, a temperature sufficient for evaporating moisture contained in said sheet of conventional paper so that said sheet of conventional paper is substantially nonconductive;

positioning said sheet of conventional paper adjacent the surface of said photoconductive material and between the surface of said photoconductive material and a supply of toner particles whereby a substantial number of toner particles are attracted toward said latent image and collect on a surface of said sheet of conventional paper in a pattern corresponding to said latent image; and heating said sheet of conventional paper with said toner particles thereon so that the toner particles fuse together and to the sheet of conventional paper.

8. A method, as set forth in claim 7, wherein said step of heating said sheet of conventional paper to remove moisture includes heating said sheet of conventional paper for a period of time and to a temperature sufficient for reducing the moisture content of said sheet of conventional paper to a level of less than 3% by weight of the conventional sheet of paper.

9. A method, as set forth in claim 7, including cooling said sheet of conventional paper to a preselected temperature after the step of heating said sheet of conventional paper to remove the moisture therefrom and before the step of positioning said sheet of conventional paper.

10. A method, as set forth in claim 9, including directing a cold air stream from a vortex tube into a region adjacent said sheet of conventional paper.

11. An electrophotographic printer, comprising:

a power supply having first and second terminals adapted for delivering electrical power therethrough;

a drum constructed from an electrically conductive material and connected to said first power supply terminal, said drum being rotatable along its longitudinal axis;

a layer of photoconductive material disposed on an outer surface of said rotatable drum;

means for rotating said drum and said layer of photoconductive material in a first rotational direction about said longitudinal axis of said drum;

a charge corotron positioned adjacent said drum and connected to said second power supply terminal, said charge corotron being adapted for depositing an electrical charge of a preselected polarity on said layer of photoconductive material;

an imaging device positioned adjacent said charge corotron and said drum, said imaging device being adapted for exposing said layer of photoconductive material to a patterned source of light so that selected portions of said electrical charge are removed from the surface of said layer of photoconductive material whereby a desired latent image is formed on the surface of said layer of photoconductive material;

means for removing moisture from a sheet of conventional paper so that said sheet of conventional paper is substantially nonconductive;

a series of transport rollers positioned between said means for removing moisture and said drum, said series of transport rollers being adapted for receiving said sheet of conventional paper from said means for removing moisture and feeding said sheet of conventional paper onto said drum, said sheet of conventional paper being positioned adjacent the surface of said layer of photoconductive material between the surface of said layer of photoconductive material and a supply of toner particles whereby a substantial number of toner particles are attracted toward said latent image and collect on a surface of said sheet of conventional paper in a pattern corresponding to said latent image; and a heater adapted for receiving said sheet of conventional paper with said toner particles positioned thereon and heating said sheet of conventional paper with said toner particles thereon so that the toner particles fuse together and to the sheet of conventional paper.

12. An electrophotographic printer, as set forth in claim 11, wherein said means for removing moisture includes a heater adapted for heating said sheet of conventional paper to a temperature sufficient for evaporating moisture contained in said sheet of conventional paper.

13. An electrophotographic printer, as set forth in claim 11, wherein said means for removing moisture includes a heater adapted for heating said sheet of conventional paper for a period of time and to a temperature sufficient for reducing the moisture content of said sheet of conventional paper to a level of less than 3% by weight of the sheet of conventional paper.

14. An electrophotographic printer, as set forth in claim 11, including means for receiving said sheet of conventional paper from said means for removing moisture and cooling said sheet of conventional paper with a cooling means to a preselected temperature.

15. An electrophotographic printer, as set forth in claim 14, wherein said cooling means includes a vortex tube having a cold air nozzle adapted for directing a cold air stream from said vortex tube into a region adjacent said sheet of conventional paper.

* * * * *